US009138760B2

(12) United States Patent
Cooper

(10) Patent No.: US 9,138,760 B2
(45) Date of Patent: Sep. 22, 2015

(54) ELECTROSTATIC LIQUID SPRAY NOZZLE HAVING AN INTERNAL DIELECTRIC SHROUD

(71) Applicant: Steven C. Cooper, Athens, GA (US)

(72) Inventor: Steven C. Cooper, Athens, GA (US)

( * ) Notice: Subject to any disclaimer, the term of this patent is extended or adjusted under 35 U.S.C. 154(b) by 266 days.

(21) Appl. No.: 13/798,729

(22) Filed: Mar. 13, 2013

(65) Prior Publication Data

US 2014/0110492 A1 Apr. 24, 2014

Related U.S. Application Data

(60) Provisional application No. 61/716,884, filed on Oct. 22, 2012.

(51) Int. Cl.

| | |
|---|---|
| ***B05B 5/08*** | (2006.01) |
| ***B05B 5/043*** | (2006.01) |
| ***B05B 7/04*** | (2006.01) |
| ***B05B 7/22*** | (2006.01) |

(52) U.S. Cl.

CPC ..... *B05B 5/043* (2013.01); *B05B 5/087* (2013.01); *B05B 7/0441* (2013.01); *B05B 7/22* (2013.01)

(58) Field of Classification Search

CPC ..... B05B 5/00–5/1691; B05B 7/0441; B05B 7/22

USPC ..... 239/690–708

See application file for complete search history.

(56) References Cited

U.S. PATENT DOCUMENTS

| | | | | |
|---|---|---|---|---|
| 4,004,733 | A | | 1/1977 | Law |
| 4,009,829 | A | | 3/1977 | Sickles |
| 4,106,697 | A | | 8/1978 | Sickles |
| 4,343,433 | A | | 8/1982 | Sickles |
| 4,664,315 | A | | 5/1987 | Parmentar et al. |
| 4,713,257 | A | | 12/1987 | Luttermoller |
| 4,735,364 | A | | 4/1988 | Marchant |
| 4,762,274 | A | | 8/1988 | Burls |
| 5,044,564 | A | | 9/1991 | Sickles |
| 5,181,661 | A | | 1/1993 | Wollard |
| 5,188,290 | A | | 2/1993 | Gebauer et al. |
| 5,685,482 | A | | 11/1997 | Sickles |
| 5,704,554 | A | * | 1/1998 | Cooper et al. ..... 239/690.1 |
| 5,765,761 | A | * | 6/1998 | Law et al. ..... 239/690.1 |
| 6,138,922 | A | | 10/2000 | Hartman et al. |

(Continued)

OTHER PUBLICATIONS

Notice of Allowance in U.S. Appl. No. 13/843,479, mailed on Mar. 16, 2015, 6 pages (pp. 1-6 in pdf).

*Primary Examiner* — Arthur O Hall
*Assistant Examiner* — Juan C Barrera
(74) *Attorney, Agent, or Firm* — Mitch Harris, Atty at Law, LLC; Andrew M. Harris

(57) ABSTRACT

An electrostatic sprayer for spraying a liquid includes a nozzle formed from a a nozzle body that has an inlet for receiving a liquid and a liquid tip having an outlet for ejection of the liquid to form a liquid spray. The nozzle also includes an electrode disposed around the outlet of the liquid tip for charging the liquid and a dielectric shroud disposed around at least a portion of the liquid tip to prevent leakage currents from reducing a potential of the electric field between the liquid and the electrode, which would otherwise reduce the effectiveness of the sprayer. A conductor that couples the electrode to a power supply may pass through a hole extending through the shroud. The shroud may include one or more vents to permit air and liquid to pass through the dielectric shroud to reduce accumulation of liquid.

24 Claims, 7 Drawing Sheets

(56) References Cited

U.S. PATENT DOCUMENTS

| | | | | |
|---|---|---|---|---|
| 6,227,466 | B1 * | 5/2001 | Hartman et al. | 239/704 |
| 6,318,647 | B1 | 11/2001 | Gaw et al. | |
| 6,326,062 | B1 | 12/2001 | Noakes et al. | |
| 6,676,049 | B2 | 1/2004 | van der Steur | |
| 7,913,938 | B2 | 3/2011 | Cooper | |
| 2003/0006321 | A1 | 1/2003 | Mather | |
| 2006/0124780 | A1 * | 6/2006 | Cooper | 239/690 |
| 2007/0063077 | A1 * | 3/2007 | Keudell et al. | 239/690 |
| 2014/0110493 | A1 | 4/2014 | Cooper | |

* cited by examiner

ELECTROSTATIC LIQUID SPRAY NOZZLE HAVING AN INTERNAL DIELECTRIC SHROUD

This U.S. Patent Application claims priority under 35 U.S.C. 119(e) to U.S. Provisional Patent Application Ser. No. 61/716,884 filed on Oct. 22, 2012.

BACKGROUND OF THE INVENTION

1. Field of the Invention

The present invention relates to electrostatic liquid spray systems, and in particular a nozzle for an electrostatic liquid spray system having an internal dielectric shroud.

2. Background of the Invention

An electrostatic spraying process charges either powder or liquid particulate to improve spray delivery and deposition. Advantages of the electrostatic charging are uniform spray cloud dispersion as well as improved uniformity and mass transfer efficiency in coating of target surfaces. In practice, many types of target surfaces are coated by electrostatic sprays; varying from agricultural crops to automobiles, appliances, furniture and many other manufactured goods. Unique opportunities for electrostatic spraying are still emerging. For example, recently developed applications involve coating of surfaces with sanitizing agents for odor control and the prevention of illness caused by virus and bacteria in areas of high human concentration such as hotels, hospitals, restaurants, schools, day care services, military installations and cruise ships.

In transport from an electrostatic nozzle, unipolar charged particles of relatively low mass maintain separation due to mutual repulsion and are driven along electric field lines to deposit uniformly. Sufficiently charged particulate clouds create strong space charge fields that propel particles near the edge of the spray cloud towards the target. The electrostatic forces due to this space charge are beneficially supplemented by image charge forces that aid the deposition process once individual particulates approach very close to the target substrate. These image charge forces are important to allow very small particles to overcome air boundary layer effects and deposit on the surface. A high ratio of particulate charge-to-mass is important to the process. Very small, highly charged particulates of high numerical density create beneficial space charge and image force fields, maximizing the electrostatic effects and minimizing the influence of gravity.

Choice of the optimal electrostatic charging method to employ for a particular application often depends on the type of spray compound and the target. For example, dry powder sprays to be delivered and deposited onto planar grounded surfaces may be suited for corona or triboelectric types of charging systems. Air assistance can be added to improve charged powder deposition for more complex three dimensional targets. Conductive liquids held in small containers and atomized by hydraulic or gas pressure may be suitably charged by direct contact of the liquid with high voltage probes. Insulating liquids and conductive liquids of relatively high resistivity can be atomized and charged reliably by electrohydrodynamic (EHD) methods as are known in the art. Conductive liquids, such as water based sprays of agricultural or sanitization chemicals, may present leakage current challenges in corona charging systems, EHD nozzles or high voltage contact systems, and may be more suited for charging by non-contact induction methods such as those disclosed in U.S. Pat. No. 3,698,635 to Sickles, U.S. Pat. No. 4,004,733 to Law, and U.S. Pat. No. 5,704,554 to Cooper and Law.

However, use of induction charging methods in the room, equipment and furniture sanitizing applications above typically requires field serviceability and robustness of the design to both servicing as well as providing continuous and extended use of the system. Therefore, it would be desirable to provide an electrostatic sprayer system that has a design robust enough for field servicing and provides the ability to operate continuously for extended periods of time with low electrical power requirement.

SUMMARY OF THE INVENTION

The above objectives, as well as others, are accomplished in a nozzle for an electrostatic sprayer, and electrostatic spray gun and system including the nozzle, as well as a method of operation of the nozzle and system.

The nozzle has a nozzle body including an inlet for receiving a liquid and a liquid tip having an outlet at a distal end for ejection of the liquid. An electrode is disposed around the outlet of the liquid tip for generating an electric field between the electrode and the liquid for charging the liquid. A dielectric shroud is disposed around at least a portion of the liquid tip to prevent leakage currents from reducing an intensity of the electric field. The dielectric shroud may be in the form of an annulus disposed around the base of the liquid tip. A conductor that supplies the electrode may extend through a passage in the dielectric shroud in a direction parallel to the central axis of the annulus. The dielectric shroud may define one or more apertures passing through the shroud for permitting liquid and/or gas to pass through.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of the invention when read in conjunction with the accompanying Figures, wherein like reference numerals indicate like components, and:

DESCRIPTION OF ILLUSTRATIVE EMBODIMENT

Figure 1:
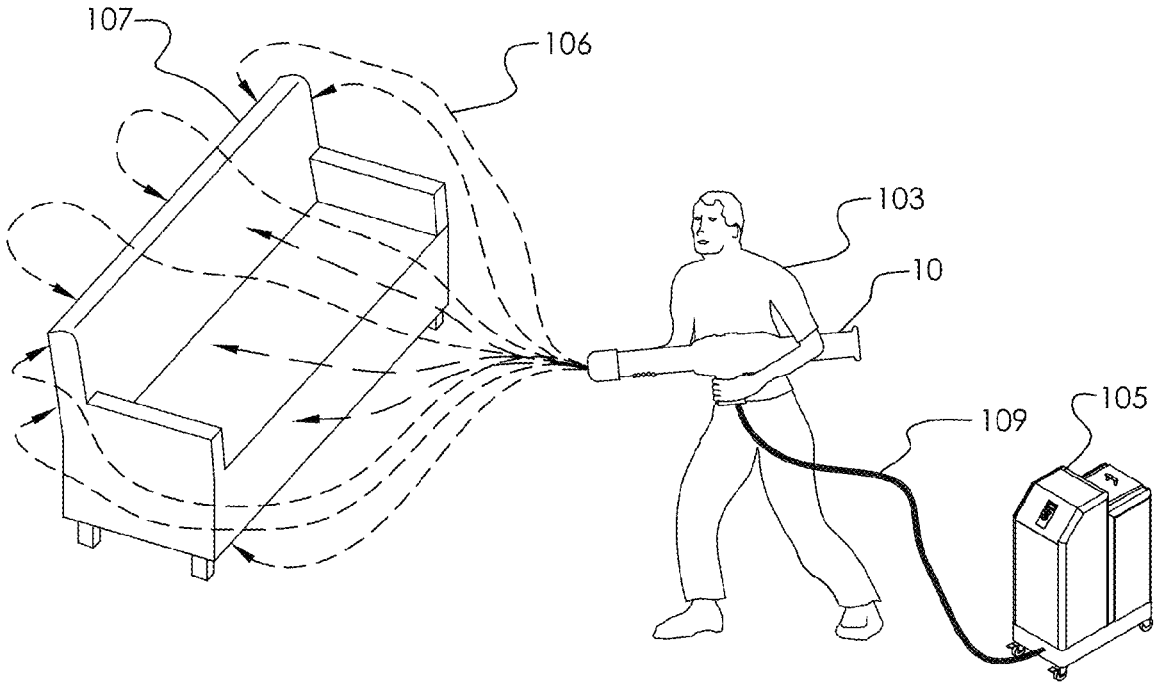
FIG. 1 is a pictorial diagram depicting operation of a system in accordance with an embodiment of the invention.

The present invention concerns electrostatic spray nozzle features, specifically features of and around a liquid tip that reduce liquid accumulation and reduction of an electrostatic charging field surrounding a liquid stream ejected by the liquid tip. Non-contact induction liquid spray charging systems operate by surrounding the spray stream at the atomization zone with an electrode, creating a non-contacting charging field between the electrode and the liquid. Pneumatic energy is often used in induction-charging nozzle systems for atomization and air assisted delivery of spray. High velocity gas, usually compressed air, passes through the gap between electrode and liquid tip. The air generally keeps the liquid from contacting the electrode, which could reduce the charging field or, in the worst case, create a direct electrical short circuit. Distinct advantages of properly implemented induction-charging systems are: the liquid reservoir can be held at or near earth potential, nozzle and tank systems store low electrical charge, relatively low voltages in the range of 800 to 1400 V can be used, and relatively low current requirements allow some induction electrode systems to run from portable battery power. The structure of the nozzle systems and spray guns shown below provides such an implementation. However, some or all of the techniques disclosed and claimed herein may provide advantages in other types of liquid spray systems, and the present invention is not limited to induction-charging systems, except as indicated by features recited in particular claims.

During induction charging, if the charging electrode of the sprayer is of positive polarity, a negative charge will be induced onto the liquid surface, and vice-versa. A disadvantage to induction charging is that the surfaces of the nozzle system will become the same polarity as the electrode if wetted or otherwise contaminated by conductive surface films. The spray droplets discharged from the nozzle wrap back to oppositely charged outer nozzle housing surfaces, due to their opposite polarity. The droplets that wrap back to the outer surfaces further contaminate them, wasting spray, causing dripping of large droplets and forming electrical leakage current paths. The problem of charged spray coating the outer housing during prolonged periods of operation was addressed in U.S. Pat. Nos. 4,240,585 and 4,343,433 to Sickles, and partially mitigated using multiple air flow outlets to help prevent charged spray from returning to the nozzle and nozzle mountings. U.S. Pat. No. 5,704,554 addresses the above-described problem by providing structures on the exterior of the nozzle that cause formation of electric force fields to electrically repel spray and keep insulator cavities clean to prevent leakage currents. However, the above-referenced Patents do not address problems caused by contamination and resulting electrical paths on the interior nozzle surfaces.

In addition to reducing the likelihood of direct shorting of the electrode and reduction of spray wrap-back issues onto exterior nozzle surfaces as mentioned above, pneumatic energy provides necessary turbulent aerodynamic forces to assist in improving coating uniformity by reducing Faraday cage effects inside hidden target areas and mitigating fringing effects on prominent target areas. Fringing refers to high deposition on edges and other prominent target geometries where electric field concentrations may be highest. Additionally, air assistance helps overcome environmental factors, such as cross-winds that move spray particulates off target.

The conductive liquid flowing through the nozzle system is earthed to provide the necessary electron flow for the induction process. Liquid resistivity can limit induction charging but only at very high values of liquid resistivity. Generally, induction-charging nozzles begin to show diminished charging capability at liquid resistivity values above approximately 100 Meg ohm cm, a much greater resistivity than would be encountered using solutions mixed with tap water. Induction-charging nozzles are thus suitable for nearly all water-based sprays, but their use is limited for very resistive spray liquids, such as pure oils. Most water-based sprays used in agricultural crop protection, commercial pest control, food safety and sanitizing fall at the opposite end of the resistivity spectrum: generally less than 10,000 ohm·cm. For agricultural applications, water from a local tap source (having resistivity ranges between 1000 to 30000 ohm·cm), is mixed on site with the concentrated chemical bringing resistivity of the final spray solution often down below 1000 ohm cm and often below 100 ohm·cm. The above-mentioned highly conductive liquids help facilitate the induction-charging process. However, highly conductive liquids can also cause various charging issues with art nozzle designs, as mentioned above, as they are operated over long periods of time and interior and exterior surfaces become conductive.

Another important issue in providing optimized charging performance in induction charging systems is control of the positioning of the electrode relative to the atomization zone. A miniature embedded electrode design used in internal air-atomizing nozzles, such as those disclosed in U.S. Pat. Nos. 4,004,733, 5,765,761 and 5,704,554 can be helpful to minimize stray current flows in induction-charging nozzles since the electrode is completely surrounded by an insulator. Only a small interior edge of the conductive cylindrical electrode is exposed along a portion of the length of the walls of the atomization channel. The electrode width needs to be sufficient to provide an adequate field along the length of the entire atomization zone. The atomization zone may shift in position and length with different types of liquid sprays due to changes in liquid flow rate and viscosity, for example. Further, changes in atomizing air energy may change the location or length of the atomization zone. Variations in the manufacturing process of the nozzle cause shifts in nozzle atomization performance. Discontinuities along the interior of the atomization channel, such as may be caused by embedding the electrode between insulators, can cause turbulence and wetting of the electrode. These atomization channel discontinuities cause the spray stream to be less collimated and the diverging turbulent spray pattern is more likely to wrap back and coat the nozzle surfaces. Machining, molding or assembly variations may result in less than optimal positioning of the liquid tip in relation to the electrode. Small variations in dimensions, variations in the linear positioning of the liquid tip along the atomization channel, or concentricity variations will cause spray atomization issues and charging fluctuations.

Another challenge with internal electrode air-atomizing type induction nozzles is in maintaining concentricity of the electrode with the liquid tip outlet. Small side-to-side variations cause atomization issues due to more airflow on one side of the liquid tip outlet. Concentricity variations also change the charging field, increasing the field intensity along one side of the tip and reducing the field intensity on the opposite side. Under such conditions, ionization of the liquid or field breakdown, e.g., arcing, may occur. Nozzles with long liquid tip lengths, such as shown in U.S. Pat. No. 3,698,635 have increased surface distance between the electrode and the liquid outlet. The increased distance may help reduce surface currents, but care must be taken to maintain concentricity between the long liquid tip and the electrode ring. In the nozzle design described in U.S. Pat. No. 6,227,466 to Hartman, the conductive nozzle body in direct electrical contact with the electrode as well as contact at the base of the liquid tip and the liquid hose connection contribute to excessive internal current leakage and resulting charging reductions. In addition, due to small variations in manufacturing, multiple venturi nozzles drawing liquid from a common source compete with each other for liquid flow. The result is a different charge and liquid flow from nozzle to nozzle along the spray boom.

Some induction-charging nozzle designs expose large areas of the electrode to the atomization zone, e.g, by providing longer electrodes. The longer length electrodes may improve charging in systems where the atomization zone is longer or changes with air and liquid flow variations. The larger electrode area is often necessary in air shear, hydraulic or high-volume/low-pressure (HVLP) nozzle types where the atomization zone is partially or fully located on the exterior of the nozzle outlet and may be longer than interior atomizers using higher air pressures and lower gas flows. Examples of air shear or hydraulic atomizers with exterior electrodes are found in U.S. Pat. No. 4,673,132 to Inculet and Castle and U.S. Pat. No. 7,150,412 to Wang, et al.

A particular advantage of induction-charging systems with miniature internal electrodes positioned in very close proximity to the liquid stream and a well-defined atomization zone are much lower power supply voltage requirements for the same or higher intensity charging field strength compared to induction systems with wide electrode gaps. The required current supplied to the electrode can be held very low if electrical leakage is prevented. Theoretically, the amount of current required from the induction electrode's power source should be extremely low—equal only to that required for maintaining the electrode at the proper voltage level. However, prior art nozzle electrode input currents 10 to 100 times higher than the emitted spray cloud currents are sometimes observed, especially after nozzles are operated for extended time periods and have become contaminated. A fraction of the excess current may be due to ionization at electrode discontinuities, but much of the excess is a result of electrical leakage along interior and exterior nozzle surfaces. The power loss due to leakage currents is usually below 0.2 to 2 Watts per nozzle for very conductive spray mixes, which is not a concern when operating from a large power supply such as a vehicle or line-operated power system. However, reducing the leakage current becomes critical when the electrostatic nozzle system is battery-powered. Leakage currents may also cause physical damage to the nozzle interior surface, reducing spray-charging reliability and reducing the life of nozzle components.

Incorporating a liquid outlet tip molded or machined to be an integral part of a plastic insulating nozzle body, as shown for example in U.S. Pat. No. 5,704,554, is an effective construction method to assist in preventing electrode leakage currents from contacting the grounded liquid through seams within the nozzle body. Unfortunately, an integral design requires that the entire nozzle body must be replaced in the event of a damaged liquid outlet tip. Such structures make repair significantly more expensive and difficult to perform since air and liquid hoses as well as electrical connections often must be disconnected and then reconnected to the replacement nozzle body.

As mentioned above, leakage currents over exterior surfaces of induction nozzles and mountings can be significant. Leakage currents on the interior of the nozzles described therein may be much smaller than those over the exterior; however, the impact on charging levels can be more significant. Not only do interior leakage paths cause excess current draw from the power supply, they also cause diminished charging as the stray voltages from the electrode eventually touch the liquid in the nozzle channels, fittings or at the tip outlet. Interior nozzle surfaces surrounding the electrode and liquid inlets and outlet areas become contaminated with moisture or other conductive residues causing the potential of the liquid to be elevated towards that of the electrode, greatly diminishing the charging field and level of the charge on the spray droplets. The liquid in the nozzle tip, being earthed some distance downstream in the nozzle channel or the tubing to the nozzle, will achieve elevated voltage as a function of the current and the resistance of the liquid in the channel. The resulting reduced level of charge is often seen happening gradually over long periods of time while the nozzles are operated continuously. It also may be seen as intermittent charge reduction when moisture from atomizing air or spray liquid builds inside the nozzle, causing momentary shorts between the electrode and the liquid, which are then generally cleared by the moving air. Embedded electrode designs having an insulated electrode are not immune to the above-described problem; contaminants render insulating surfaces of the nozzle interior conductive, and those contaminated surfaces then are in contact with surfaces of the liquid tip or fittings connected to the liquid channels. The structure of the nozzle systems and spray guns described in detail below reduce or eliminate the above-described problems.

Referring now to FIG. 1, a system and method for disinfecting items in a room are illustrated. A spray gun 10 that dispenses an electrostatically-charged disinfecting spray cloud 106 is directed at a sofa 107 by an operator 103. Spray gun 10 is an electrostatic spray gun in accordance with an embodiment of the invention as illustrated in further detail below. A base unit 105 provides a source of liquid and air pressure via hose connections 109, and optionally provides a source of power, although a battery within spray gun 10 is included to provide power in the embodiments disclosed herein. The liquid ejected from the tip of spray gun 10 coats surfaces more uniformly and generates a liquid cloud pattern that can reach hidden surfaces underneath and behind sofa 107 providing more effective disinfection than would be possible with ordinary sprays and without moving and upending sofa 107.

Figure 2:
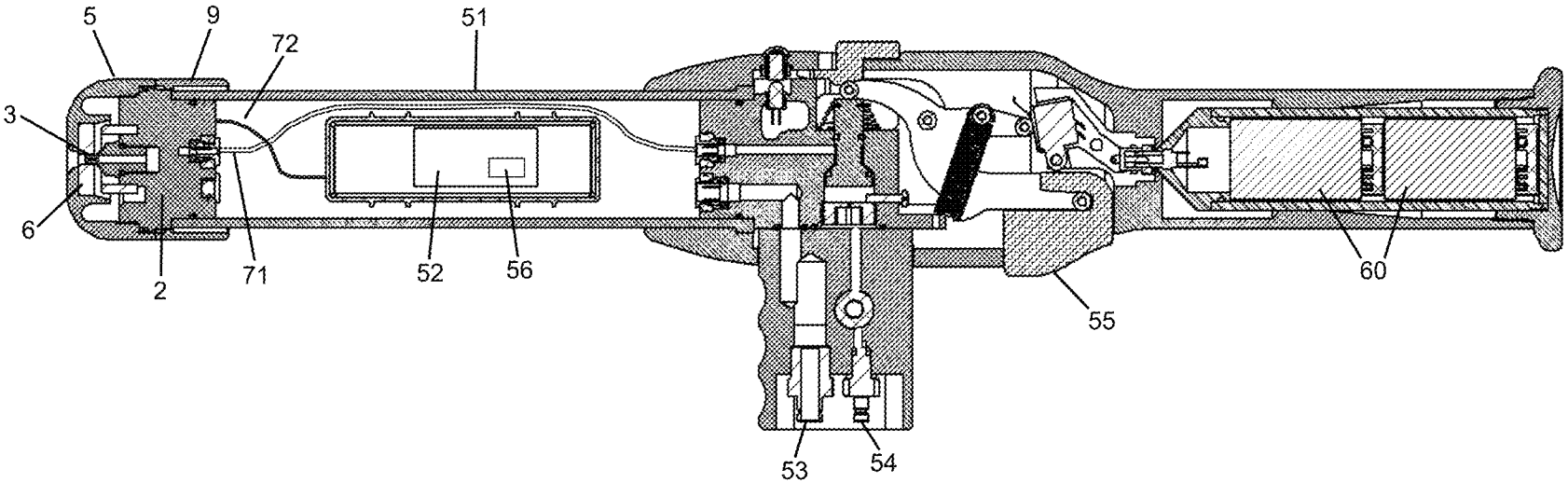
FIG. 2 is a side cross-section view of electrostatic spray gun 10 of FIG. 1.

Referring now to FIG. 2, internal features of spray gun 10 are shown in accordance with an embodiment of the invention. Spray gun 10 is operated by a trigger 55 that controls passage of liquid into a liquid hose 71 that supplies the liquid to a port on a nozzle body 2 within spray gun 10. The liquid is supplied to a liquid inlet 54 and air pressure is supplied to an air inlet 53 from hoses 109 of FIG. 1. Batteries 60 supply input power to an electrostatic power supply 52 that is activated by an air pressure switch 56, which senses when sufficient air pressure is present for proper atomization and charging of the liquid. Electrostatic power supply 52 has an output electrically coupled by a nozzle electrode wire 72 to an electrode 6 that charges liquid sprayed from a liquid tip 3. A locking ring 9 provides a calibrated stop, so that a cap 5 can be removed and reattached when cleaning or repairing components at the nozzle end of spray gun 10. Cap 5 and locking ring 9 are fastened to an end of a mounting tube 51 that contains electrostatic power supply 52 and other components of spray gun 10. The interior region of mounting tube 51 houses liquid hose 71, wiring including nozzle electrode wire 72, and any optional air hoses to protect these components from the harsh spraying environment. In the depicted embodiment, the inside of mounting tube 51 is pressurized, so that no air hose is required to supply pressurized air to nozzle body 2. In an alternative embodiment, an air hose may couple pressurized air between nozzle body and the pressurized air supply at an entrance to mounting tube 51. Mounting tube 51 is preferably nonconductive to reduce leakage currents from the nozzle or power supply components.

Figure 3:
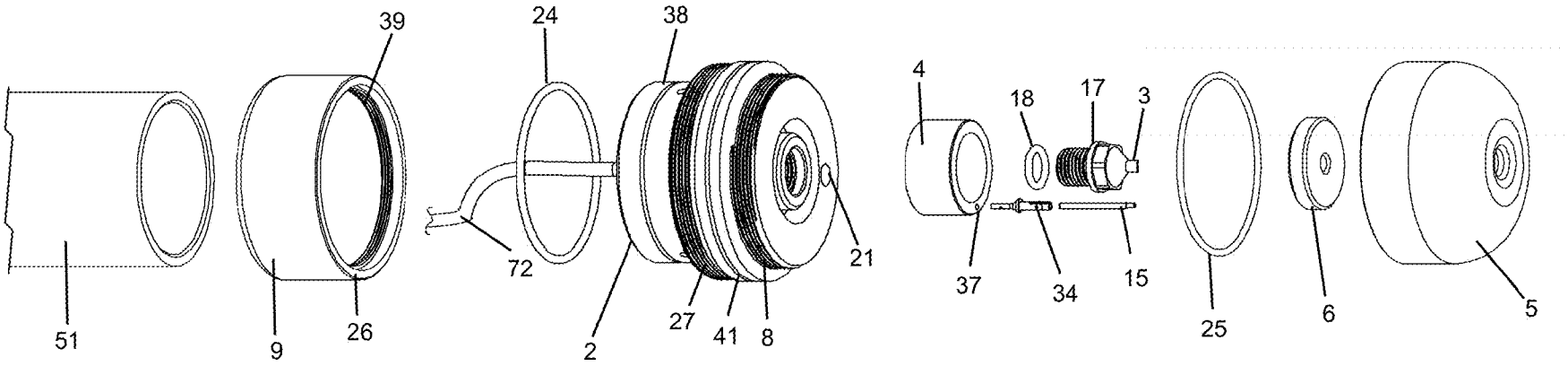
FIG. 3 is an exploded view showing details of an electrostatic spray nozzle end of electrostatic spray gun 10 of FIGS. 1-2.

Referring now to FIG. 3, an exploded view is shown of an exemplary spray nozzle assembly as may be configured at the end of mounting tube 51 of spray gun 10 as shown in FIG. 2. Such a configuration is not limited to use in a spray gun and may be used, for example, in a tractor-mounted field sprayer arrangement, or other electrostatic sprayer configurations, including other sanitizing or cleaning systems. Nozzle body 2 includes a seal 24 that fits into a groove 38 along the outer portion of nozzle body 2. Mounting tube 51 is fitted to a base of nozzle body 2 and locking ring 9 surrounds nozzle body 2 at the end of mounting tube 51. Seal 24 provides for containing pressurized gas within mounting tube 51, and may not be necessary if a hose and fitting at the gas inlet on the proximal face of nozzle body 2 is included according to an alternative embodiment, but may be preferred to prevent contamination of other components within mounting tube 51 and electrical leakage to earth. Gas is provided to a distal face of nozzle body 2 through a gas channel 21 that terminates on the distal face of nozzle body 2. Alternatively more than one gas channel 21 may be provided. A liquid inlet hose (not shown) is attached to the proximal end of nozzle body 2 to provide liquid to liquid tip 3 through one or more liquid channels within nozzle body 2. Nozzle electrode wire 72 is also attached to the proximal end of nozzle body 2 and provides electrical current to electrode 6 through a contactor 15. A socket 34 receives contactor 15 and is electrically connected to electrode wire 72. With the above arrangement both nozzle electrode wire 72 and a liquid hose may be protectively encased in mounting tube 51. Mounting tube 51 desirably protects electrode wire 72 to eliminate exposure to the wet environment. In one embodiment, mounting tube 51 is manufactured from an electrically-insulating material to offer further protection against leakage currents from the sources of high voltage to the liquid stream or earthed components. Locking ring 9 includes interior threads 39 that mate to complementary threads 27 of nozzle body 2. The threads 39, 27 have a fine pitch to allow a distal edge 26 of locking ring 9 to function as a precise stop location for the linear position adjustment of cap 5, which thereby controls the position of electrode 6 with respect to liquid tip 3. In the depicted embodiment, a base portion 17 of liquid tip 3 is threaded to mate with complementary threads in nozzle body 2 and a flexible seal 18 may be provided to provide a gas, electrical, and liquid-tight connection between liquid tip 3 and nozzle body 2. However, in accordance with other embodiments, liquid tip 3 may be formed on nozzle body 2, or may be a tube of single diameter that is press-fit into a mating recess within nozzle body 2. Cap 5 is secured to nozzle body 2 via threads 8. Another seal 25 fits into a seal groove 41 of nozzle body 2 to form a seal between nozzle body 2 and an interior edge of cap 5. In an alternative embodiment, threads 27 and threads 8 may be provided by a single continuous thread on the exterior of nozzle body 2. Seal 25 functions to contain gas pressure within cap 5 as cap 5 is adjusted along mounting tube 51 by rotation of cap 5 along threads 8. An electrically-insulating dielectric shroud 4 at least partially surrounds a base portion 17 of liquid tip 3 and in the exemplary embodiment, is press-fit into the distal face of nozzle body 2. Dielectric shroud 4 includes a hole 37 passing through dielectric shroud 4 to allow contactor 15 to pass through dielectric shroud 4 and make contact with electrode 6. Dielectric shroud 4 may be integral to nozzle body 2, or may be made removable for cleaning or replacement, by fitting dielectric shroud into a press-fit recess in nozzle body 2, or by a threaded connection. Dielectric shroud 4 may be fabricated from the same material as nozzle body 2, or of a different material.

Figure 4:
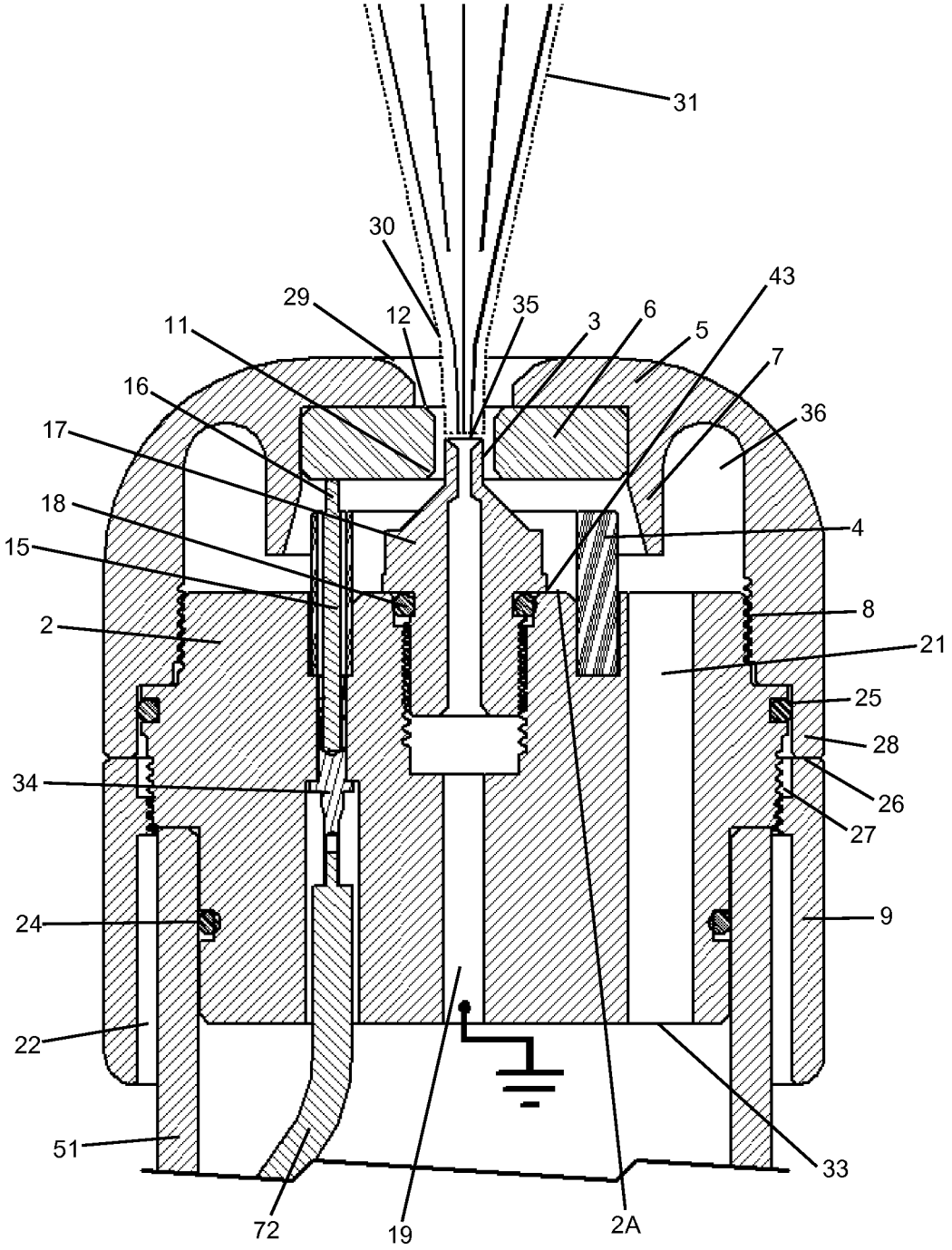
FIG. 4 depicts a cross-section of an electrostatic spray nozzle assembly that may be used within electrostatic spray gun 10, in accordance with an embodiment of the invention.

Referring now to FIG. 4, details of a nozzle assembly are shown as may be implemented in spray gun 10 of FIGS. 1-3. The nozzle assembly includes nozzle body 2, liquid tip 3 with a base portion 17 removably coupled to nozzle body 2, dielectric shroud 4 and cap 5 containing electrode 6, as described above. Dielectric shroud 4 surrounds base portion 17 of liquid tip 3 and forms a gap along a surface of nozzle body 2 between base portion 17 of liquid tip 3 and the inner surface of dielectric shroud 4. Cap 5 also has an electrode shroud 7 that surrounds and extends beyond the proximal face of electrode 6. Electrode shroud 7 may be made removable via a press-fit, or threaded connection and may be fabricated from the same material as cap 5, or from a different material. Electrode 6 may also be removable and may be integrated with a removable electrode shroud 7. Air or other pressurized gas enters nozzle body 2 at an inlet 33 and passes though gas channel 21. A single gas channel 21 is shown, but alternative implementations may have multiple gas channels. For example, a number of gas channels may be provided around the circumference of nozzle body 2 to reduce pressure losses and balance gas flow. Liquid enters nozzle body 2 through a separate liquid channel 19. The liquid may be connected to earth or a reference potential differing from that of electrode 6 at some location within nozzle body 2 or at any point upstream of nozzle body 2 including the liquid source, such as a tank within base unit 105 of FIG. 1. Liquid is ejected from an outlet 35 of liquid tip 3 where the liquid is atomized by high velocity gas, usually air, flowing into a central channel 11 through electrode 6 that is disposed around the periphery of the proximal end of liquid tip 3 at outlet 35. The collimated stream of atomized droplets 30 exits an outlet 12 of electrode channel 11 forming a charged spray cloud 31. Electrode 6 is manufactured from a conductive and abrasive resistant material, preferably stainless steel or similar metal. Alternatively, a conductive or semi-conductive plastic material may also be utilized for the electrode 6. Cap 5 is a suitable non-conductive plastic with low surface wettability characteristics and characteristics that help prevent a continuous path of contamination to develop in order to limit electrical tracking along interior and exterior surfaces. Electrode shroud 7 is annular in shape and surrounds electrode 6. Electrode shroud 7, in combination with dielectric shroud 4, substantially blocks leakage currents from travelling from electrode 6 and eventually contacting the liquid at seam 43 formed by contact points between base 17 of the liquid tip 3 and nozzle body 2, at outlet 35 of liquid tip 3 or at other locations within the nozzle assembly or mounting tube 51.

Flexible seal 18 provides additional protection against leakage currents contacting the liquid within liquid channel 19 of nozzle body 2 or within the liquid channel extending through liquid tip 3. Electrode shroud 7 may be integral to cap 5 or be a separate piece of the same or a different material removably attached by threads, press-fit, molded into place, or otherwise attached to cap 5. The material of electrode shroud 7 is generally non-conductive plastic, ideally a plastic providing good electrical insulation and low surface wettability characteristics, such as PTFE, UHMW, Glass, or other suitable dielectric material. Nozzle electrode wire 72 passes into nozzle body 2 and terminates at socket 34 that receives contactor 15. In the example, the insulation of nozzle electrode wire 72 is sealed into the nozzle body 2. An o-ring can be provided within the channel that receives nozzle electrode wire 72 or a non-conductive adhesive or both can be used to ensure an air and liquid seal as well as an electrically tight seal between the wire insulation and nozzle body 2. In the depicted example, the base of the contactor 15 is shown within dielectric shroud 4 and a contactor pin 16 that contacts the electrode 6 extends above dielectric shroud 4. Alternate placement of contactor pin 16 could be outside of dielectric shroud 4, to the side of dielectric shroud 4 and away from base 17 of liquid tip 3. The placement of dielectric shroud 4 blocks stray currents between high voltage portions of the nozzle system, the liquid channels, and liquid tip 3. Nozzle electrode wire 72 is connected to a suitable power supply (not shown) preferably providing 400 to 2500 volts DC. Contactor pin 16 may be spring loaded and extend and retract into contactor base 15, as cap 5 is removed and attached or adjusted. Socket 34 simplifies removal and replacement of contactor 15 from the distal face of nozzle body 2 when cap 5 is removed. However, in accordance with alternative implementations, nozzle electrode wire 72 may be connected to a solid contactor without requiring socket 34 or contactor pin 16.

As mentioned above, locking ring 9 provides adjustable stop edge 26 to limit the movement of electrode cap 5 along adjustment threads 27 which mate to threads on nozzle body 2. The above-described arrangement provides an adjustable positioning and setting mechanism to allow fine adjustment of the position of the outlet end of liquid tip 3 within the electrode channel 11 relative to electrode outlet 12. Locking ring 9 enables precise and repeatable adjustment of the positioning of liquid tip 3 with respect to electrode 6 by rotating cap 5, and the adjustment can be performed while the nozzle is operating. The position of stop edge 26 may be re-settable, which enables calibration of the location of liquid tip outlet 35 relative to electrode 6 to allow for variations in the length and location of the atomization zone due to nozzle component manufacturing variations, as well as for variations in the flow rates or pressure of gas or liquid, or for variation in liquid properties such as viscosity and solids content. Locking ring 9 is generally constructed of a non-conductive plastic. Locking ring 9 may incorporate an air gap 22 to provide increased electrical tracking distance between the high voltage components of the nozzle assembly and the mount for the nozzle. In the depicted embodiment, a non-conductive mounting tube 51 is shown attached to the nozzle body 2. Air gap 22, which extends between locking ring 9 and the outer surface of mounting tube 51 provides a cavity on the outer surface that is less susceptible to contamination from drifting spray around the nozzle. The depicted structure of the spray nozzle provides for access to gap 22 for periodic cleaning if necessary, especially with very conductive sprays used for long periods of time. In one exemplary design, seal 24 may be used to provide additional protection against electrical leakage currents on contaminated nozzle surfaces. An additional seal 25 may be used to prevent electrical current flows along interior surfaces to the outside of the nozzle system which may become conductive due to surface films. Seal 25 may be positioned to allow a sealing surface between the nozzle body 2 and cap 5 even as electrode 6 is adjusted by rotation of cap 5 along mating threads 8. Seal 25 allows a seal maintaining air pressure and against stray electrical currents during operation as cap 5 (and thus the position of electrode) is adjusted by rotation.

A feature of the above-described nozzle system is that each principle component of the nozzle system is easily removable and replaceable from the front (distal end) of the nozzle. The primary components are accessible by removing cap 5. Some nozzle components may become damaged in use or cleaning, may wear out over time, or may need to be changed to provide a different spray characteristic, flow rate, or spray pattern. Cap 5 may be removed from the nozzle body 2 by un-threading of mating threads 8. During re-assembly, the positioning of the stop is preserved by the position of locking ring 9. Locking ring 9 may be cemented into place at the threads or otherwise anchored, e.g., by a set screw, to prevent movement and keep the position of stop edge 26 fixed during repeated removal and re-installation of cap 5. In one implementation, electrode 6 may be press fit into a recess in cap 5. Electrode 6 may be removable from cap 5 for replacement, or alternatively the entire cap 5 and electrode 6 assembly may be integral and replaced together. In instances where various flow characteristics or spray patterns are desired, such as may be achieved with a larger or smaller electrode opening or channel length, the entire cap 5 may be replaced with an alternate cap. In some configurations, the length of a skirt 28 on cap 5 contacting stop edge 26 may be longer or shorter depending on the spray characteristics desired and depending on how a larger or smaller electrode opening may change the necessary electrode-to-liquid-tip placement dimension to achieve optimum atomization and spray droplet charging. For example, the adjustment of the distance between electrode outlet 12 and outlet 35 of liquid tip 3 using adjustment provided by threads 8 and locking ring 9 and/or various electrode cap skirt lengths 28 may be useful to provide optimum adjustment to obtain a very narrow, collimated spray stream 30 at an outlet 29 of cap 5. Collimation of spray stream 30 helps to carry droplets in charged spray cloud 31 further from the nozzle at increased velocity, helping to prevent them from being electrically attracted back onto outer nozzle surfaces and mountings. Electrode 6 in the depicted embodiment is constructed as one piece with a smooth interior channel with the central channel and outlet 12 of electrode 6 is smaller or equal in diameter compared to outlet 29 of cap 5.

An implementation of the spray nozzle of FIG. 4 includes removable liquid tip 3 with base portion 17 all formed from dielectric material to prevent stray electrode voltages from contacting the liquid stream. Mating threads 8 may be used to provide the mating connection, or the parts may be joined by other methods, such as a press fit. Mating threads 8 or other removable connection of nozzle body 2 and base portion 17 of liquid tip 3 allow removal of liquid tip 3 from nozzle body 2 and provides a seal against leakage currents passing from high voltage locations to the liquid within the inside liquid channel 19 and inside liquid tip 3. Flexible seal 18 may be used to provide additional protection against electrode-to-liquid stray leakage currents in this critical interior area, helping to prevent current or liquid leakage when the surfaces of nozzle body 2 and or base portion 17 of liquid tip 3 become contaminated during disassembly for replacement and/or servicing. In one embodiment, base portion 17 of liquid tip 3 may be constructed with wrench flats to enable liquid tip 3 and base 17 to be removed easily as a unit from nozzle body 2 using a tool, for example, using a nut driver or a tool especially made to fit a keyed surface of base 17 of liquid tip 3.

As described above, dielectric shroud 4 is included to provide a barrier to electrical leakage currents between high voltage parts, such as electrode 6, contactor 15, contactor pin 16, socket 34, and liquid tip outlet 35. Dielectric shroud 4 may surround liquid tip 3 and base portion 17 and may have solid walls or may have walls with openings to allow gas to pass through and around liquid tip 3. Dielectric shroud 4 may be cylindrical (annular) in shape or have a hexagonal, square or other cross-section. Dielectric shroud 4 is formed from an electrically-insulating material and may be integral to the nozzle body or constructed as a separate piece and press-fit or threaded into a channel in nozzle body 2, as shown, or over a flange (not shown) raised above the mating surface of nozzle body 2 and liquid tip 3. It may be advantageous to fabricate dielectric shroud 4, electrode shroud 7 or other mating parts from a different type dielectric material than that to which dielectric shroud 4 and electrode shroud 7 are adjacently joined, since disruption of the paths of surface leakage currents appear to be improved at the seams of the dissimilar insulating materials. One or both of dielectric shroud 4 and electrode shroud 7 may be removable for cleaning or replacement. It may also be desirable to fabricate any or all of dielectric shroud 4, electrode shroud 7 and liquid tip 3 from a material that has low surface wettability and characteristics that prevent formation of continuous electrical leakage paths. Some examples of such materials are ultra-high-molecular-weight polyethylene (UHMW), polytetrafluoroethylene (PTFE), or other materials such as glass or materials with surface coatings, such as non-stick treatments, that render them desirable as insulators in wet and contaminated environments encountered in spraying. Electrical tracking may be interrupted more effectively if dissimilar materials are used for nozzle body 2 and dielectric shroud 4 and/or electrode shroud 7.

While the presence of either of electrode shroud 7 or dielectric shroud 4 will generally reduce leakage currents, the presence of both is desirable, especially if very conductive liquid sprays are used, for instance below 500 ohm cm resistivity, or for spray liquids that tend to leave surface residues. As shown in the embodiment depicted in FIG. 4, when the nozzle system is assembled, electrode shroud 7 and dielectric shroud 4 form a labyrinth arrangement providing no direct line for gas flow. Single or multiple shrouds surrounding liquid tip 3, a cavity 36 or multiple cavities within cap 5 and/or multiple shrouds and cavities surrounding electrode 6 may be used to increase the level of electrical isolation between the liquid and the high voltage components. The multiple shrouds and cavities may form more sophisticated labyrinth structures to increase tracking distances while beneficially keeping the physical size of the entire nozzle system reasonably small. In the particular example, pressurized gas, usually compressed air, enters nozzle body 2 at air inlet 33, is conveyed through gas channel 21, through the interior labyrinth(s), over the labyrinth edges, and may follow a tortuous path until finally reaching electrode channel 11. The flowing gas is eventually squeezed through the smaller opening surrounding the liquid tip outlet 35 at a further increased velocity where the gas energy atomizes the spray within electrode channel 11 and carries the spray away from the nozzle at electrode outlet 12 in a thin collimated spray stream 30 as the spray is emitted from the exterior face of electrode cap 5 through outlet 29. The gas moving through the nozzle areas and especially over the edges of the shroud structures keeps these interior surfaces clean and helps reduce interior leakage currents.

In one exemplary nozzle system, the compressed gas moving past liquid tip outlet 35 may create a negative pressure in liquid channel 19. The resulting venturi-pumping action may be adjusted by the position of electrode outlet 12 relative to liquid tip outlet 35 of liquid tip 3. The adjustment may be facilitated by the adjustment threads 8 provided between mating parts of nozzle body 2 and cap 5. Setting of the adjustment can be controlled by the locking ring 9 and stop position 26. Alternate embodiments may include electrode caps with a skirt edge 28 of different lengths to allow for different spray characteristics, such as the aforementioned venturi setting. The interchangeable electrode caps may be switched out as needed.

Figure 5:
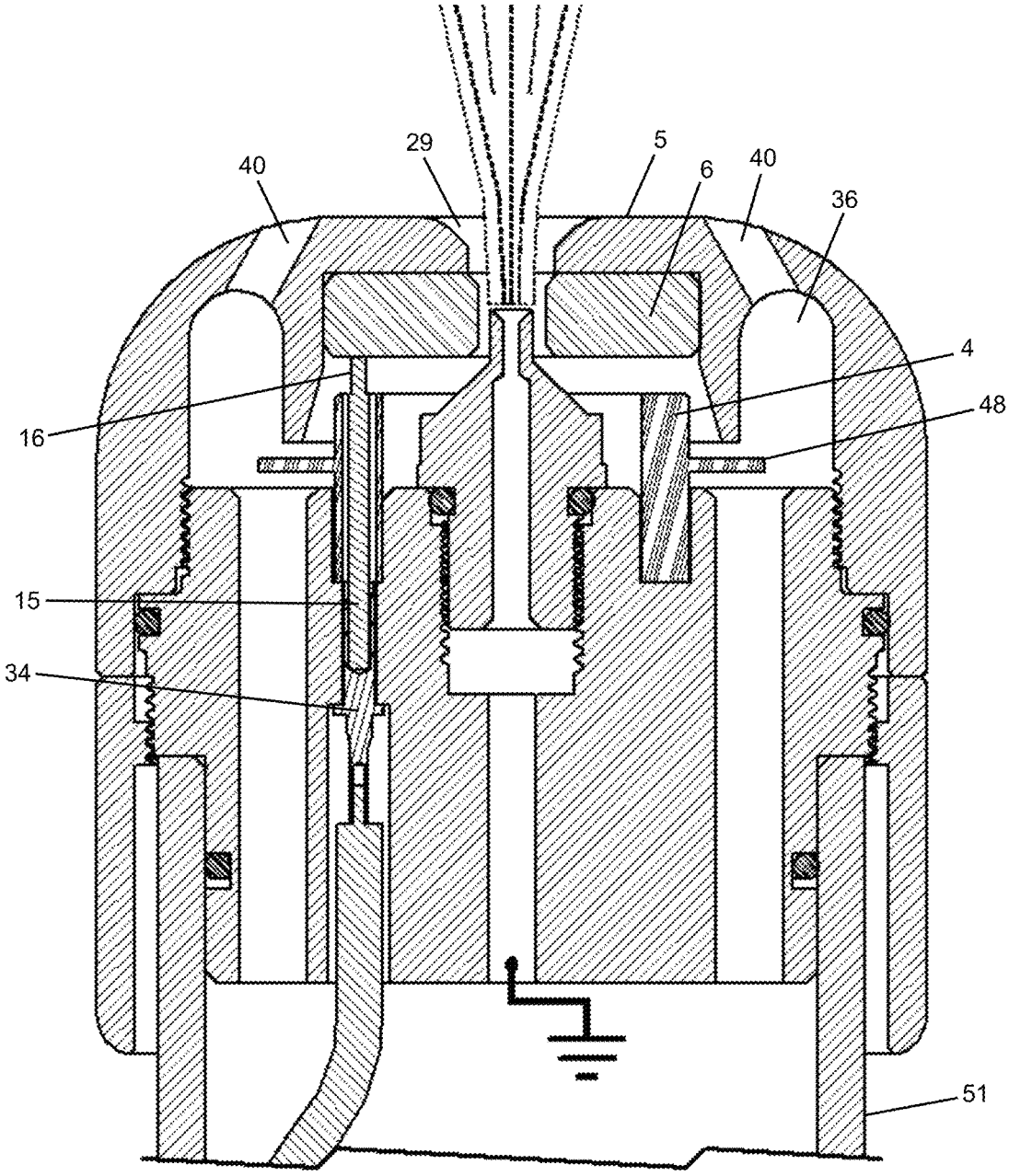
FIG. 5 shows a cross-section of another electrostatic spray nozzle assembly that may be used within electrostatic spray gun 10, in accordance with another embodiment of the invention.

Referring to FIG. 5, another exemplary spray nozzle is shown in accordance with another embodiment of the invention. The spray nozzle of FIG. 5 is similar to the spray nozzle depicted in FIG. 4 as described above, so only differences between them will be described in further detail below. The spray nozzle of FIG. 5 incorporates one or more gas openings 40 that extend from cavity 36, through the front face of cap 5. Gas openings 40 can be provided in an opposing formation to form the spray pattern into a shape, such as a flat fan shape. Alternatively, gas openings 40 can be placed around the periphery of outlet 29 of cap 5 to collimate the spray and provide additional moving air to drive charged spray away from nozzle system surfaces, e.g. cap 5, and mounting tube 51 towards the intended target. Gas openings 40 may alternatively be made through both electrode 6 and cap 5 adjacent to outlet 29. Another feature included in FIG. 5 is a modification to dielectric shroud 4 to include a ridge 48 extending around dielectric shroud 4 in a disc shape. Ridge 48 provides a further obstacle to formation of conductive paths through the air passages in the nozzle system.

Figure 6:
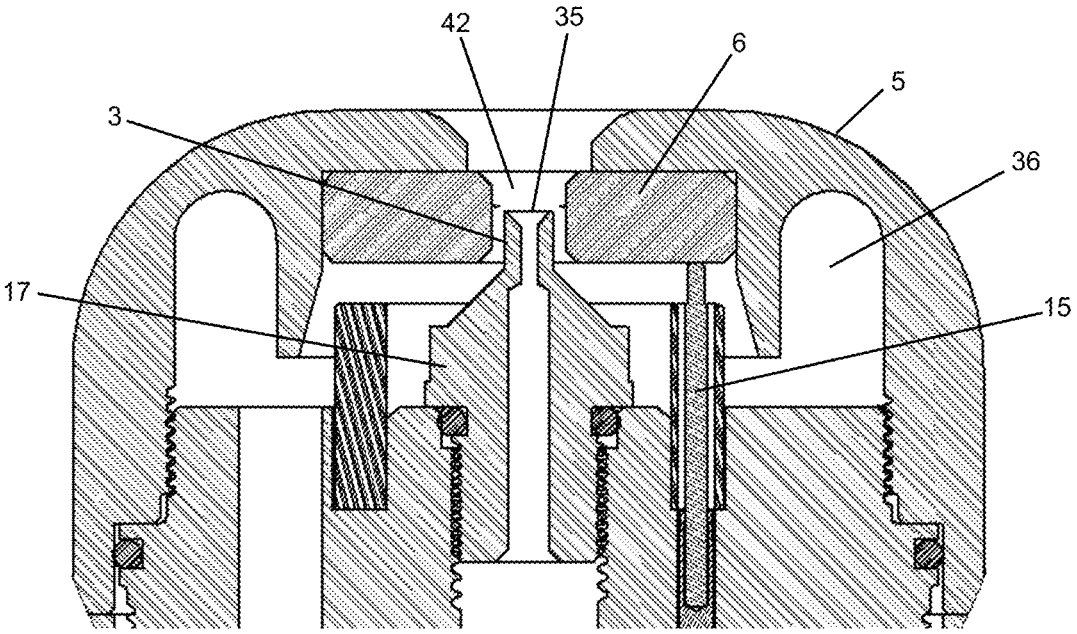
FIG. 6 shows a detailed cross-section of yet another electrostatic spray nozzle assembly that may be used within electrostatic spray gun 10, in accordance with another embodiment of the invention.

Referring to FIG. 6, yet another exemplary spray nozzle is shown in accordance with yet another embodiment of the invention. The spray nozzle of FIG. 6 is similar to the spray nozzle depicted in FIG. 4 as described above, so only differences between them will be described in further detail below. The spray nozzle of FIG. 6 includes a discontinuity 42 disposed around the periphery of electrode channel 11 to increase the field intensity in the vicinity of outlet 35 of liquid tip 3. Discontinuity 42, which in the depicted embodiment has a triangular cross-section profile and extends in a ring around electrode channel 11, permits more precise control of the positioning of electrode 6 with respect to liquid tip 3 by concentrating the effective optimal position of electrode 6 and liquid tip 3 in a narrow range of positions. In each of the above configurations, outlet 35 of liquid tip 3 is the widest diameter of a Y-shaped profile extending through liquid tip 3, which concentrates the electrostatic charging at the outside diameter of liquid tip 3 at outlet 35. By including both discontinuity 42 and the Y-shaped profile of liquid channel 19 through liquid tip 3, more precise control of the region of charging of the liquid spray is achieved.

Figure 7:
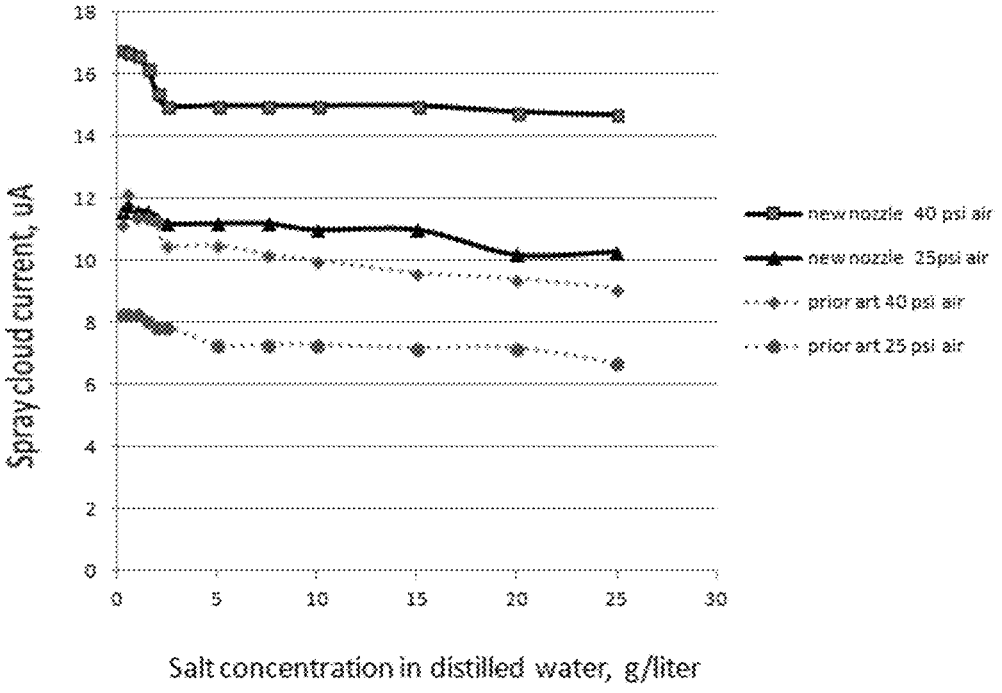
FIG. 7 shows a graph of spray cloud currents measured during operation of the electrostatic nozzles of FIGS. 4-6 in comparison to a prior art nozzle.

FIG. 7 shows results of a series of relative spray charging measurements at various concentrations of conductive salt solutions. The spray charging levels achieved are compared between a prior art embedded electrode induction nozzle and the induction-charging nozzle of the present invention as described above. Electrode voltage, liquid flow rate and air flow rate were set similarly for both nozzles. The relative spray cloud charge flow measurement was made by spraying directly onto a metal plate positioned within 5 cm of the nozzle face. The electrode cap of the nozzle system of the present invention was adjusted as described previously herein to optimally position the electrode with respect to the liquid tip to produce an increased charging level. The adjustment also produces a more narrow collimated spray stream which greatly reduces spray wrap-back and deposit on the nozzle. Dripping and ionization from liquid peaks on the nozzle surfaces were beneficially reduced with the improved nozzle of the present invention.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A nozzle for an electrostatic sprayer, the nozzle comprising:

a nozzle body having an inlet for receiving a liquid;

a removable liquid tip having an outlet at a distal end thereof for ejection of the liquid, wherein the base of the liquid tip is removably mounted to the nozzle body and contacts a surface of the nozzle body forming a seam;

an electrode disposed around the outlet of the liquid tip for generating an electric field between the electrode and the liquid for charging the liquid;

a dielectric shroud separate from the nozzle body and mounted on the nozzle body so that the dielectric shroud is disposed around the base of the liquid tip at the surface of the nozzle body to form a gap extending between the seam and an inner surface of the dielectric shroud, to prevent leakage currents from reducing an intensity of the electric field; and a removable cap secured to the nozzle body and covering the removable liquid tip and the dielectric shroud.

2. The nozzle of claim 1, wherein the dielectric shroud is configured for removable insertion into a recess in the nozzle body, whereby the dielectric shroud is removable and replaceable.

3. The nozzle of claim 1, wherein the electrode induces electrical charge flow in the liquid near the outlet, and wherein the nozzle body includes another inlet for receiving a pressurized gas to eject an electrostatically-charged liquid spray from the outlet.

4. The nozzle of claim 1, wherein the dielectric shroud is formed by an annulus partially inserted in the recess and extending around a proximal end of the liquid tip and extending from the nozzle body.

5. The nozzle of claim 4, wherein the dielectric shroud defines one or more apertures passing radially therethrough, whereby gas and liquid are permitted to pass through the dielectric shroud.

6. The nozzle of claim 4, wherein the dielectric shroud defines a passage extending therethrough in a direction parallel to a central axis of the annulus, and further comprising a conductor extending through the passage for supplying an electrical potential to the electrode.

7. The nozzle of claim 4, wherein the dielectric shroud further includes a projection extending from and around an exterior cylindrical surface of the annulus.

8. The nozzle of claim 4, wherein the dielectric shroud includes a ridge extending from an outer surface of the dielectric shroud parallel to the surface of the nozzle body.

9. The nozzle of claim 1, wherein the dielectric shroud is a first dielectric shroud wherein the electrode is captive in the cap, and wherein the cap includes a second dielectric shroud formed around the electrode at an inside surface of the cap projecting toward the nozzle body to surround at least a portion of the first dielectric shroud.

10. The nozzle of claim 9, wherein the second dielectric shroud is removably fitted to the cap for cleaning or replacement.

11. The nozzle of claim 1, wherein the dielectric shroud includes a ridge extending from an outer surface of the dielectric shroud parallel to the surface of the nozzle body.

12. The nozzle of claim 1, wherein the dielectric shroud is removably fitted to the nozzle body for cleaning or replacement.

13. An electrostatic spray system, comprising:

a source of pressurized gas;

a source of liquid;

a spray gun coupled to the source of pressurized gas and the source of liquid, wherein the spray gun includes a nozzle having a nozzle body with an inlet for receiving the liquid, a removable liquid tip having an outlet at a distal end thereof for ejection of the liquid, wherein the base of the liquid tip is removably mounted to the nozzle body and contacts a surface of the nozzle body forming a seam, an electrode disposed around the outlet of the liquid tip for generating an electric field between the electrode and the liquid for charging the liquid, a dielectric shroud separate from the nozzle body and mounted on the nozzle body so that the dielectric shroud is disposed around the base of the liquid tip at the surface of the nozzle body to form a gap extending between the seam and an inner surface of the dielectric shroud, to prevent leakage currents from reducing an intensity of the electric field, and a removable cap secured to the nozzle body and covering the removable liquid tip and the dielectric shroud.

14. The electrostatic spray system of claim 13, wherein the dielectric shroud is formed by an annulus partially inserted within a recess within the nozzle body and extending around a proximal end of the liquid tip and extending from the nozzle body.

15. The electrostatic spray system of claim 14, wherein the dielectric shroud defines one or more apertures passing radially therethrough, whereby gas and liquid are permitted to pass through the dielectric shroud.

16. The electrostatic spray system of claim 13, wherein the dielectric shroud is a first dielectric shroud, wherein the electrode is captive in the cap, and wherein the cap includes a second dielectric shroud formed around the electrode at an inside surface of the cap projecting toward the nozzle body to surround at least a portion of the first dielectric shroud.

17. The electrostatic spray system of claim 16, wherein the dielectric shroud includes a ridge extending from an outer surface of the dielectric shroud parallel to the surface of the nozzle body.

18. A method of spraying a liquid, comprising:

receiving the liquid at an inlet of a nozzle;

ejecting the liquid from a distal end of a removable liquid tip of the nozzle to form a liquid spray, wherein the base of the liquid tip is removably mounted to a nozzle body and contacts a surface of the nozzle body forming a seam;

generating an electric field between an electrode disposed around an outlet of the removable liquid tip and the liquid;

preventing leakage currents from reducing an intensity of the electric field by providing a dielectric shroud separate from the nozzle body and mounted on the nozzle body so that the dielectric shroud is disposed around the base of the liquid tip at the surface of the nozzle body to form a gap extending between the seam and an inner surface of the dielectric shroud; and securing a removable cap to the nozzle body covering the removable liquid tip and the dielectric shroud.

19. The method of claim 18, wherein the electric field induces electrical charge flow in the liquid near the outlet, and wherein the method further comprises receiving a pressurized gas to eject an electrostatically-charged liquid spray from the outlet.

20. The method of claim 18, wherein the providing provides the dielectric shroud as formed by an annulus partially inserted within a recess within the nozzle body and extending around a proximal end of the liquid tip and extending from the nozzle body.

21. The method of claim 20, wherein the providing provides a dielectric shroud defining one or more apertures passing radially therethrough, whereby gas and liquid are permitted to pass through the dielectric shroud.

22. The method of claim 21, further comprising supplying current to the electrode from a conductor passing through a passage extending through the dielectric shroud in a direction parallel to a central axis of the annulus.

23. The method of claim 18, wherein the providing further provides a second dielectric shroud inside the removable cap projecting toward the nozzle body to surround at least a portion of the liquid tip.

24. The method of claim 23, wherein the providing provides the dielectric shroud including a ridge extending from an outer surface of the dielectric shroud parallel to the surface of the nozzle body.

* * * * *